United States Patent [19]

Lawrence et al.

[11] 4,328,919

[45] May 11, 1982

[54] IMPROVEMENTS IN AND RELATING TO STITCHERS

[75] Inventors: Brian R. Lawrence, Olney; Peter M. Downing, Maidenhead, both of England

[73] Assignee: Xerox Corporation, Stamford, Conn.

[21] Appl. No.: 106,197

[22] Filed: Dec. 21, 1979

[30] Foreign Application Priority Data

Dec. 29, 1978 [GB] United Kingdom ..... 50327/78

[51] Int. Cl.[3] ..... B25C 5/04; B27F 7/19

[52] U.S. Cl. ..... 227/155; 227/152

[58] Field of Search ..... 227/155, 3–6, 227/7, 84, 85, 88, 152

[56] References Cited

U.S. PATENT DOCUMENTS

| | | | |
|---|---|---|---|
| 1,169,339 | 1/1916 | Maynard | 227/155 |
| 1,612,870 | 1/1927 | Leschhorn | 227/155 |
| 1,852,060 | 4/1932 | Peterson | 227/155 |
| 2,585,807 | 2/1952 | Mackechnie | 227/155 |
| 2,979,722 | 4/1961 | Nasmith et al. | 1/2 |
| 2,987,729 | 6/1961 | Taunton | 1/220 |
| 3,796,364 | 3/1974 | Fritz et al. | 227/110 |
| 3,804,317 | 4/1974 | Gelzer | 227/155 |
| 3,981,425 | 9/1976 | Megumi | 227/155 |
| 4,194,666 | 3/1980 | Spehrley et al. | 227/155 |

FOREIGN PATENT DOCUMENTS

| | | | |
|---|---|---|---|
| 610274 | 3/1935 | Fed. Rep. of Germany | 227/155 |

*Primary Examiner*—Paul A. Bell

*Attorney, Agent, or Firm*—Bernard A. Chiama

[57] ABSTRACT

A wire stitcher for binding sets of sheets has a driver for driving a staple through a set and an active clincher for bending over the ends of the staple legs to form clinches. The clincher includes an ear having a first groove in a side edge for catching the end of a driven staple leg and initiating bending of the leg and a second, narrower groove in an end edge, which is contiguous with the groove and aligns the leg and completes the bending thereof. A transition groove portion connects the grooves at the junction of the edges.

4 Claims, 12 Drawing Figures

Figure 1:
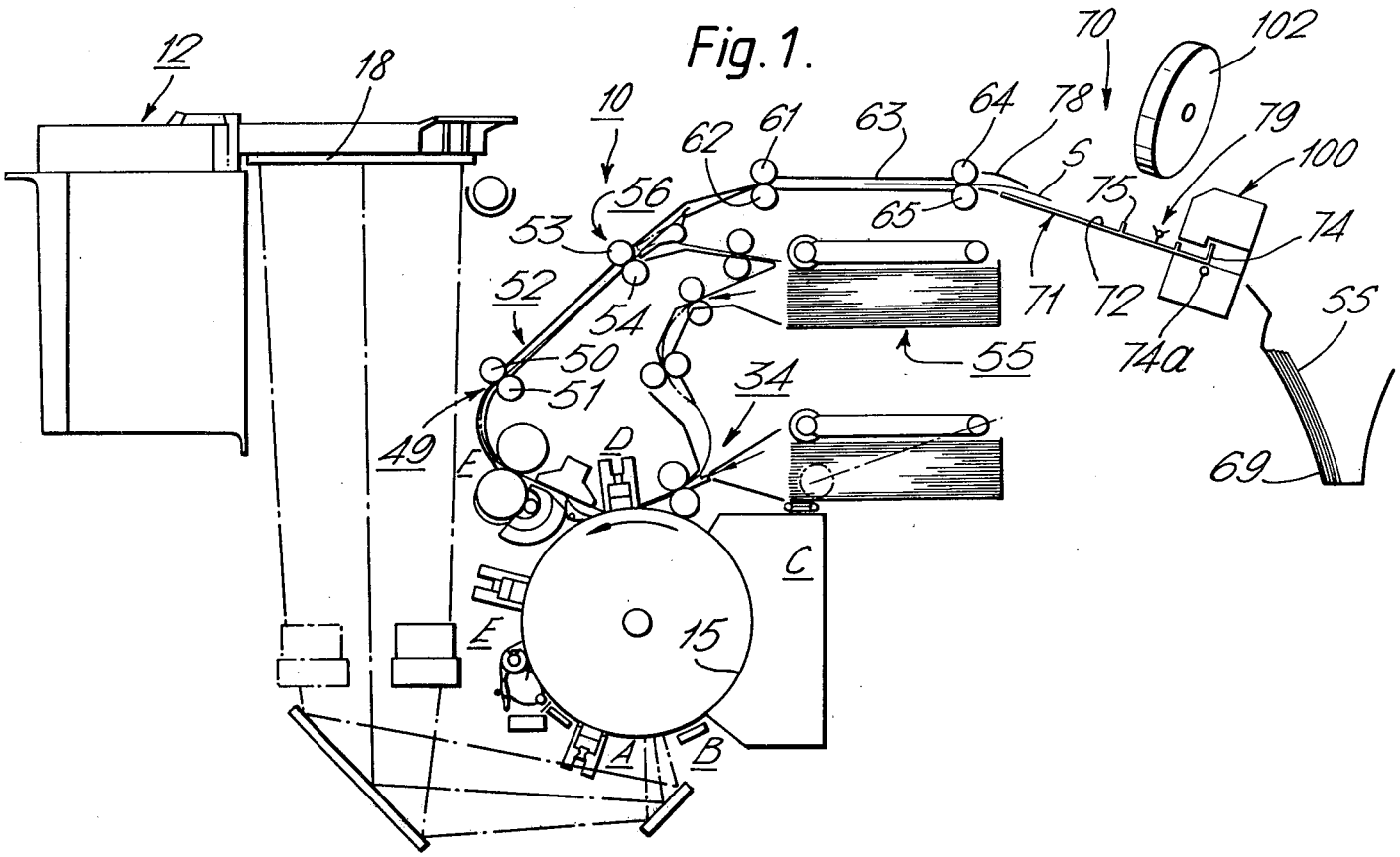

105
106
105
107
108
104
W
104a
W
120
103
123
120
122
124
55
106
109
125
121
138
139
202
206
210
205
205
204
105
110
104
101
203
208
201
207
209
217

IMPROVEMENTS IN AND RELATING TO STITCHERS

This invention relates to clinchers for wire stitchers and stitchers incorporating same, particularly those for use in binding sets or signatures of sheets or documents. Stitchers take various well-known forms. There are those (called staplers) which use pre-formed staples, those using pre-cut lengths of wire which are formed in the machine and those in which the staples are formed from a continuous wire wound on a spool from which pieces are cut and formed in the machine. In each case the legs of the formed staple or stitch are driven through the set until the crown of the staple lies against one face of the set and the ends of the staple legs are bent over against the opposite face of the set to form clinches. The present invention is concerned with stitchers of all the above kinds.

More particularly this invention is concerned with stitchers for binding sheets into sets which have active clinchers, that is to say clinchers having ears which are positively driven to bend the staple legs against the set. Examples of stitchers having active clinchers are shown in U.S. Pat. Nos. 2,964,749, 2,987,729, 3,804,317 and 3,986,533. When a staple is driven through a set of sheets the legs tend to wander from the straight line path of the driver, the amount of leg wander being generally proportional to the thickness of the set. By knowing the size and strength of the staples, the geometry of the leg tip and the set thickness one may determine the normal leg wander which will occur, it being understood that normal leg wander is that which will occur except in the case of malformed or maverick staples or misfeeds.

When mounting electrical components on circuit boards by inserting the leads thereof through preformed holes in the board and bending over the ends of the leads, it is known from U.S. Pat. No. 3,804,317 to delay the operation of the clincher until the legs are fully inserted. With preformed holes as used there, leg wander as occurs in binding sets is not a problem and also the need for a neat and accurately aligned clinch is less essential. In the set binding art on the other hand it is normal to provide narrow, grooved ears which serve accurately to align the clinches but it is then necessary to operate the clincher during the driving operation so that the staple legs are gathered by the staple ears as they emerge from the set thus minimising the effect of leg wander. Even so, failures due to leg wander are not uncommon.

According to the present invention, there is provided, in or for a wire stitcher for binding a set of sheets having a driver for driving a staple through a said set, an active clincher for bending over the ends of the staple legs to form clinches, wherein the clincher includes a clincher ear having a first groove for catching the end of the staple and initiating bending of the leg and a second, narrower groove contiguous with the first groove for aligning the leg and completing the bending thereof.

With such an arrangement, a groove which is sufficiently wide to accommodate normal leg wander catches the staple leg and alignment is effected by a narrower groove which may be shallow enough positively to press the clinch against the set.

In a preferred form the clincher has a pair of ears and each ear has said first and second grooves respectively formed in a side edge and an end edge thereof with a transition groove portion connecting the grooves at the junction of said edges. The clincher has a set clamping surface and the ears are driven through a combined pivoting and translating movement between a retracted position below the surface in which their side and end edges are respectively inclined towards and away from each other in the staple driving direction and a position in which the side edges are generally parallel and the end edges project slightly beyond the clamping surface but are preferably still inclined away from each other by a small angle, e.g. about 5°, so as slightly to overclinch the staple.

The stitcher may be incorporated with a sheet stitcher/compiler as part of a finisher for a photocopier and such a finisher may form part of the photocopier or take the form of a separate unit.

Figures 2, 3:
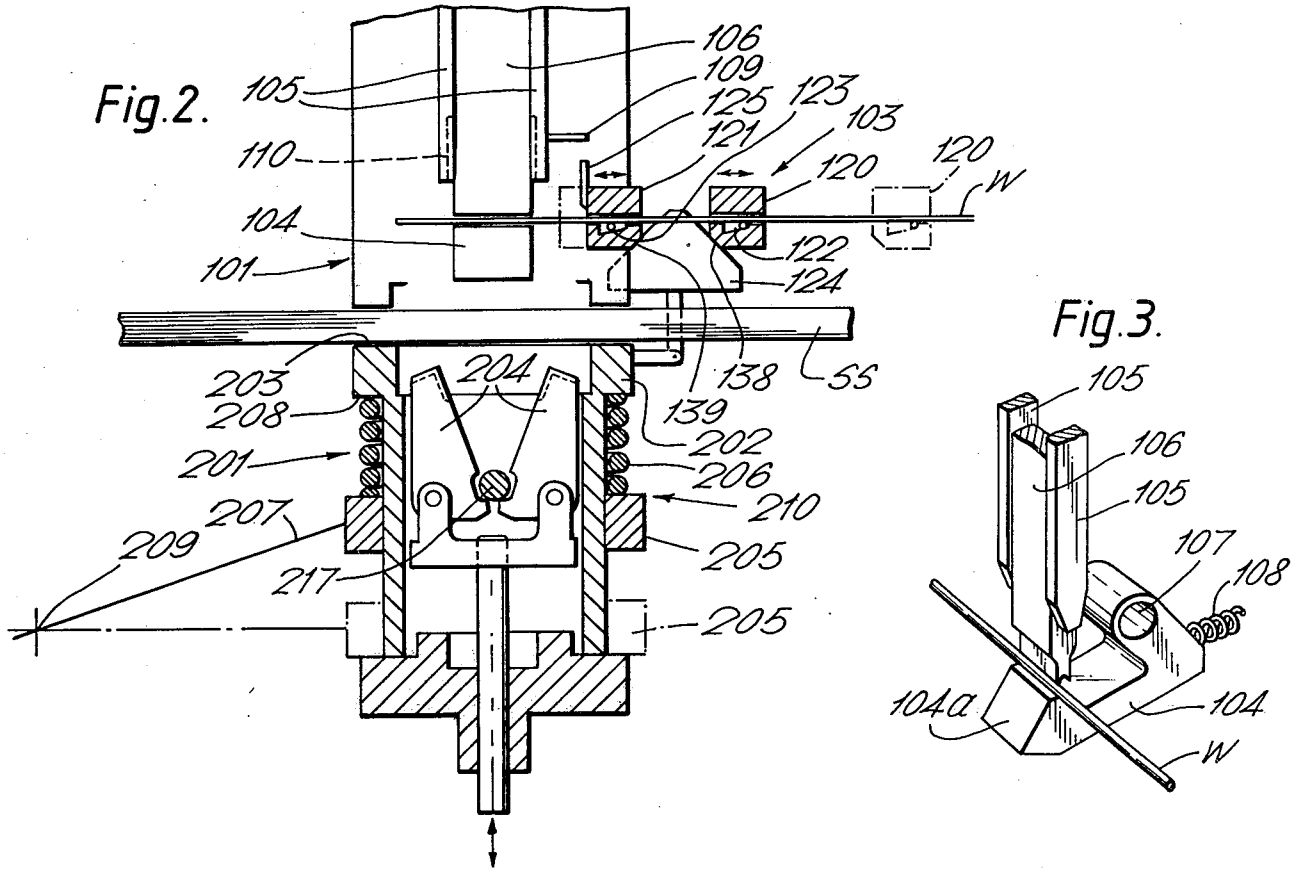
Figure 4:
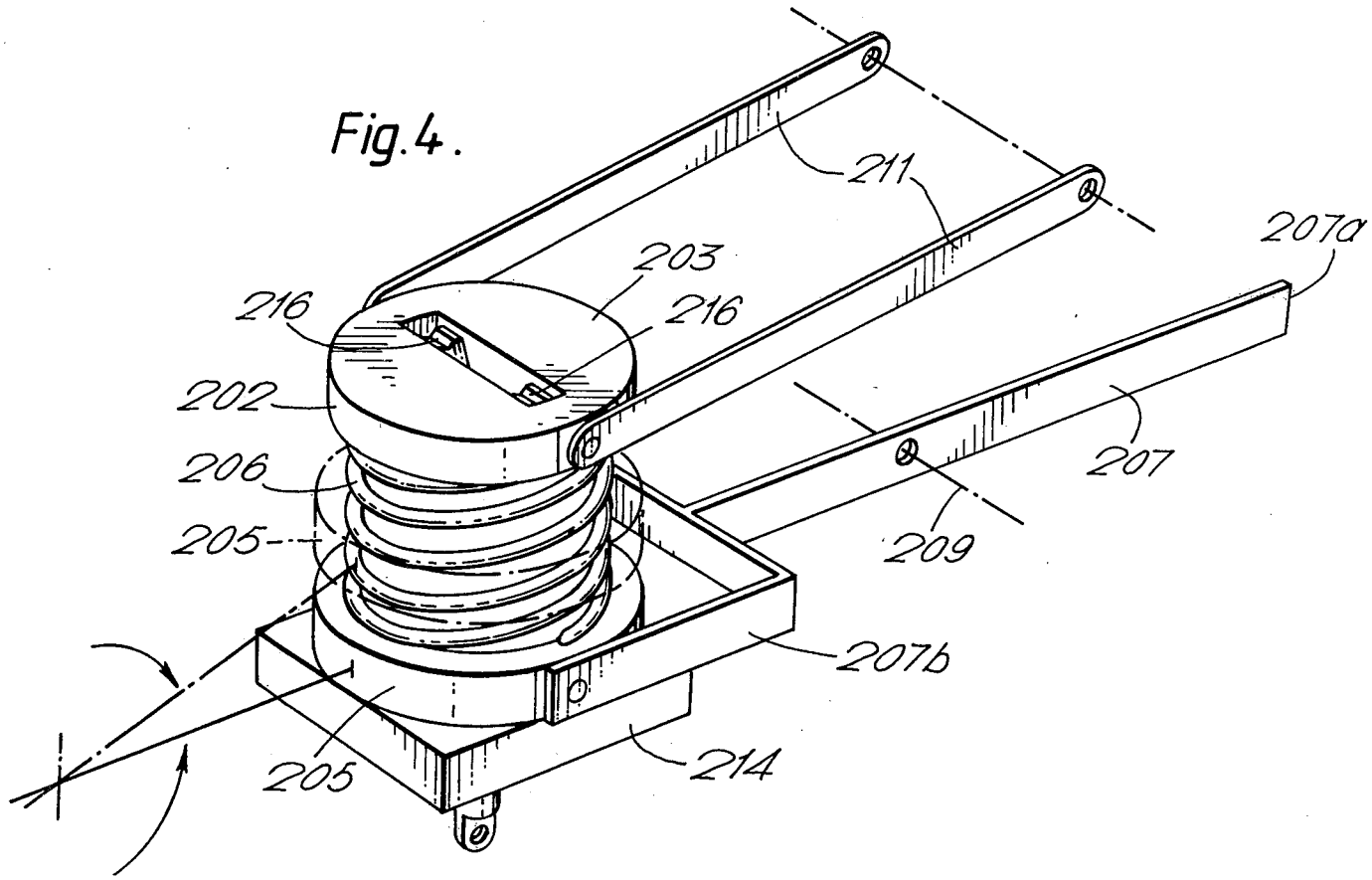
Figure 5:
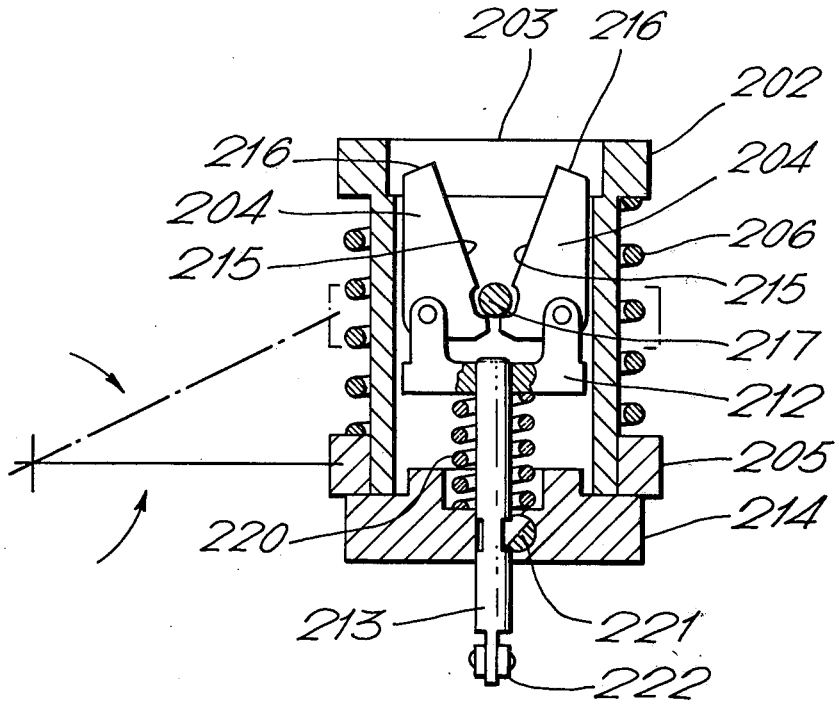
Figure 6:
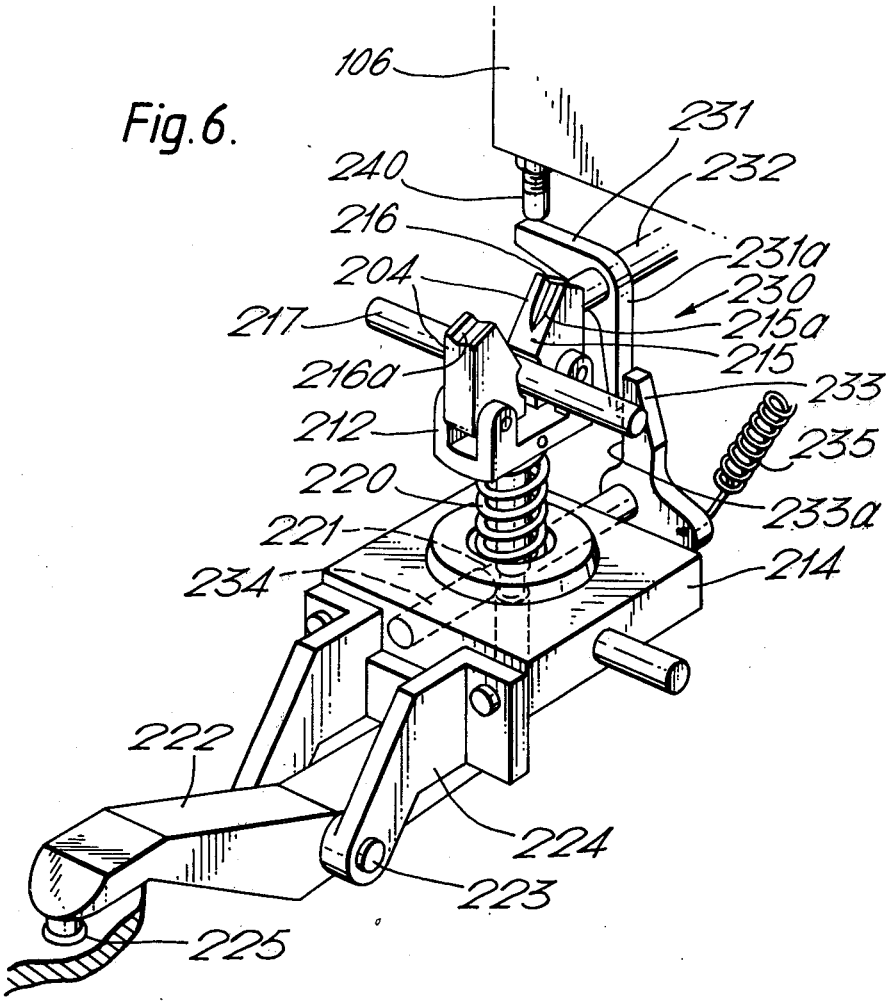
Figure 7:
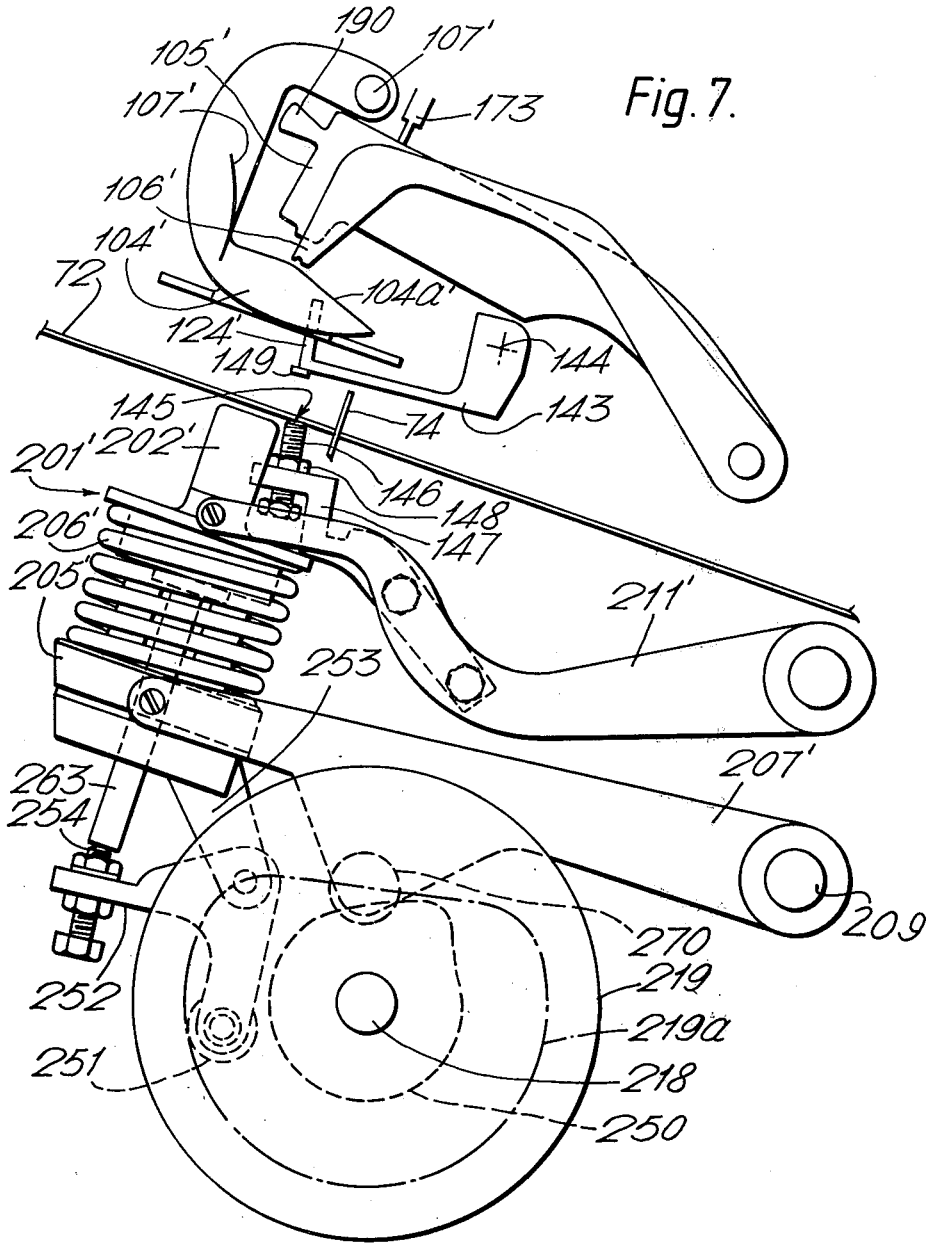
Figure 8:
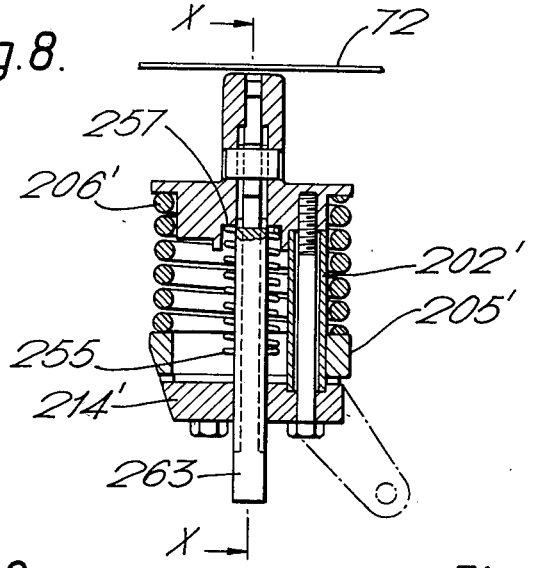
Figure 9:
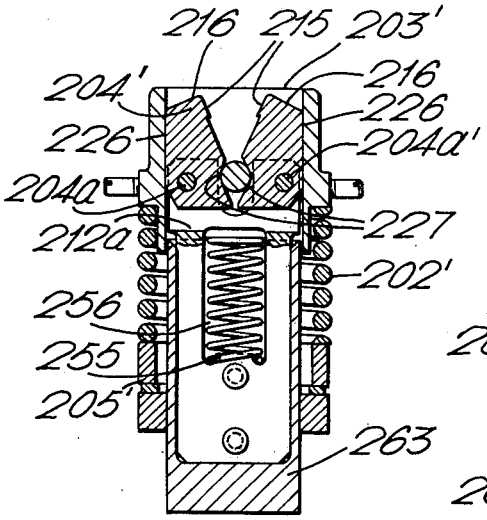
Figure 10:
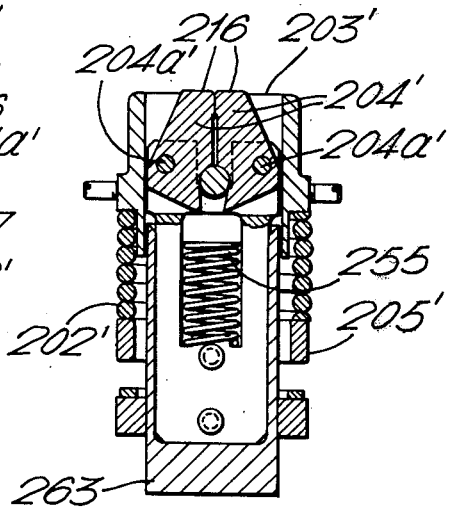
Figure 11:
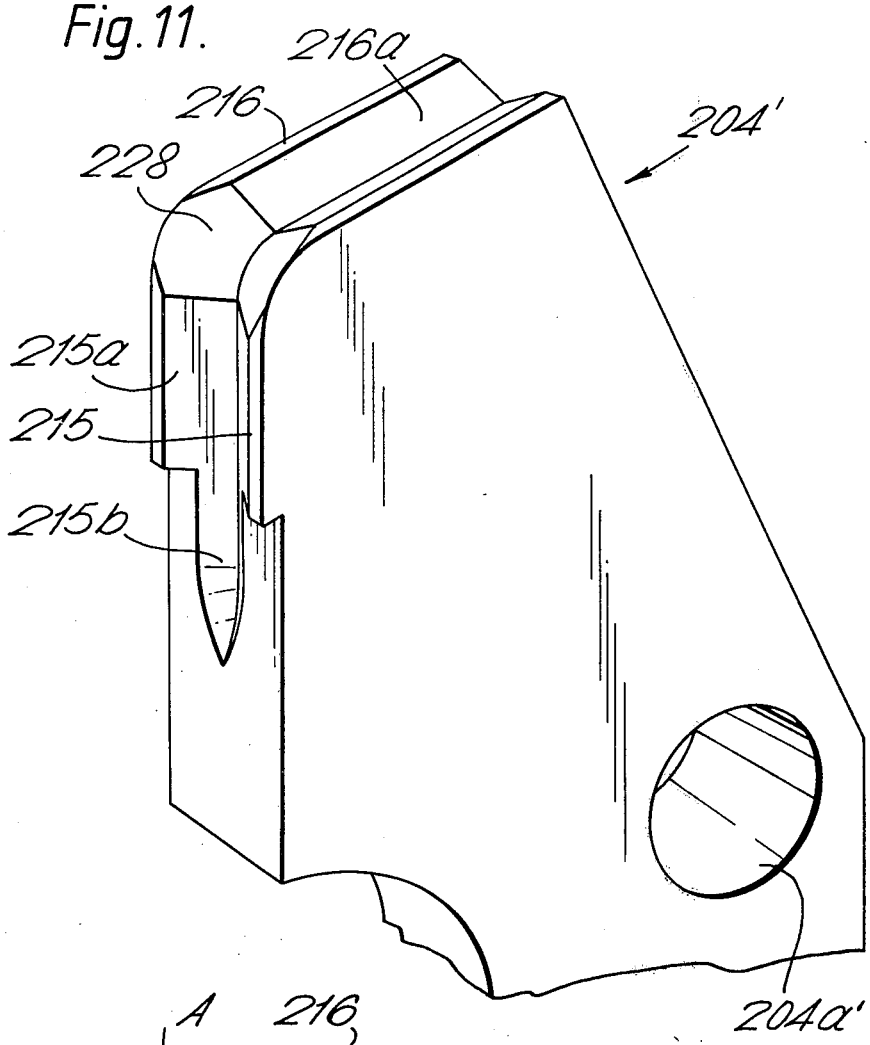
Figure 12:
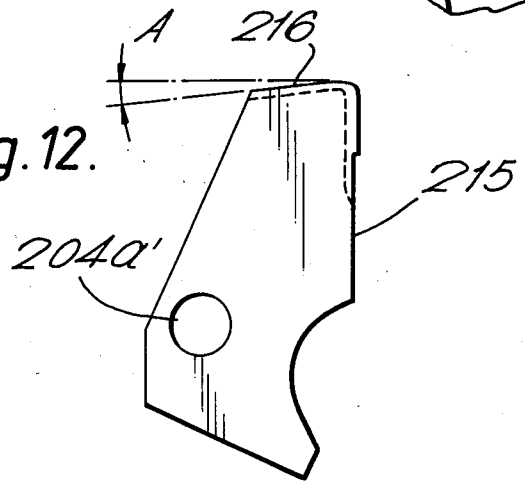

In order that the invention may be more readily understood, reference will now be made to the accompanying drawings in which:

FIG. 1 is a schematic side elevation of an exemplary form of photocopier incorporating a finisher incorporating a stitcher according to this invention, FIG. 2 is a schematic view illustrating the principles of one embodiment of stitcher of this invention suitable for use in the finisher of FIG. 1, FIG. 3 is a scrap view of the stitcher shown in FIG. 2 illustrating schematically the relationship of various parts of the stitcher, FIG. 4 is a schematic perspective view of the clincher showing the drive therefor, FIG. 5 is a sectional view of the clincher showing the clincher ear drive, FIG. 6 is a further perspective view of the clincher, with the clincher housing omitted, showing in greater detail the drive mechanism for the clincher ears, FIG. 7 is a side elevation of a second embodiment of stitcher according to the invention suitable for use in the machine shown in FIG. 1, FIG. 8 is a section through the clincher of the stitcher shown in FIG. 7, FIGS. 9 and 10 are sections of the clincher along X—X of FIG. 8, respectively showing the clincher ears in their retracted and clinch completed positions, FIG. 11 is a scrap perspective view of a clincher ear suitable for use in a clincher according to the invention, and FIG. 12 is a side elevation of a modified clincher ear.

Referring to FIG. 1 there is shown an automatic xerographic reproducing machine 10 having a finisher 70 incorporating a stitcher 100 according to this invention. The copying machine 10 is capable of producing either simplex or duplex copies in sets from a wide variety of originals which may be advanced in recirculating fashion by recirculating document apparatus 12 described in U.S. Pat. No. 3,556,512. Although the present invention is particularly well suited for use in automatic xerography, the apparatus generally designated 100 is equally well adapted for use with any number of devices in which cut sheets of material are delivered or compiled in a set or stack.

The processor 10 includes a photosensitive drum 15 which is rotated in the direction indicated so as to pass sequentially through a series of xerographic processing stations: a charging station A, an imaging station B, a developer station C, a transfer station D and a cleaning station E.

A document to be reproduced is transported by document handling apparatus 12 from the bottom of a stack to a platen 18 and scanned by means of a moving optical scanning system to produce a flowing light image on the drum at B. Cut sheets of paper are moved into the transfer station D from sheet registering apparatus 34 in synchronous relation with the image on the drum surface. The copy sheet is stripped from the drum surface and directed to a fusing station F. Upon leaving the fuser, the fixed copy sheet is passed through a curvilinear sheet guide system, generally referred to as 49, incorporating advancing rolls 50 and 51. The advancing rolls forward the sheet through a linear sheet guide system 52 and to a second pair of advancing rollers 53 and 54. At this point, depending on whether simplex or duplex copies are desired, the simplex copy sheet is either forwarded directly to the finisher 70 via pinch rolls 61, 62 or into upper supply tray 55 by means of a movable sheet guide 56 before the finishing apparatus for the duplexed copy. Movable sheet guide 56, and associated advancing rolls are prepositioned by appropriate machine logic system to direct the individual sheets into the desired path.

The finisher 70 comprises a tray 71 having a base or support surface 72 inclined downwardly in the direction of sheet travel towards a registration corner 73 (FIG. 2) defined by registration fences 74, 75 extending along the lower edge and one side of the tray. Above the upper end of the support surface is arranged a pair of coacting sheet feed rolls 64, 65 arranged to receive sheets fed along path 63 by pinch rolls 61, 62. From the feed rolls 64, 65, a sheet is directed by guide throat 78 towards the tray 71. A corner registration device 79 such as a paddle wheel like that described in U.S. Pat. No. 3,669,447 is arranged over the surface 72 to urge the sheets S into the registration corner to position them for receiving a stitch from the apparatus 100. The registration fence 74 is rotatable about an axis 74*a* so that it may be retracted for ejection of bound sets SS into a collection tray 69. Any suitable ejection mechanism, such as drive rollers, may be employed.

Referring now to FIGS. 2 and 3 of the drawings, the stitcher 100 comprises a stitcher head 101, a reel 102 (FIG. 1) from which wire W is supplied via a dancer (not shown) to the head 101 and an active clincher 201. The head 101 includes a wire advancing and cutting mechanism generally indicated at 103 for presenting lengths of cut wire to the stitcher head, an anvil 104 for supporting the wire, a former 105 including two elements at opposite sides respectively of the driver for forming the wire into a generally U-shape about the anvil and a driver 106 for driving the formed staple through the set SS. The clincher 201 comprises a clincher housing 202 having a clamping surface 203 by which a set SS may be clamped against the underside of the stitcher head 101 and containing clinch ears 210 arranged to recieve and act upon staple legs driven through the set and into the housing through a slot in the surface 203.

In FIG. 2, the clincher 201 is shown in its operative position with a set SS positioned against the head 101 which is fixed in position above the compiler tray. It will be understood, however, that during compilation of the set, the clincher is lowered so that the clamping surface 203 is below the support surface 72 of tray 71. During a stitching operation the clincher 201 is raised to lift the set SS against the underside of the head 101 and clamp it in position. Variations in set thickness are accommodated by the drive mechanism 210 by which the clincher housing is raised to lift the set against the underside of the stitcher head and clamp it into position to receive a stitch. This mechanism comprises a force applying ring 205 which lifts the housing via a compression spring 206, being moved through a fixed distance by a lever 207 (see FIG. 4). The spring 206 is positioned between the force applying ring 205 and a shoulder 208 and the lever 207 which is arranged to pivot about axis 209 is actuated by a cam (not shown) which acts on its free end 207*a*. As shown in FIG. 4 the other end of the lever is bifurcated to form a yoke 207*b* which is pivotally connected to the force ring 205. The clincher housing 202 is supported and guided by a pair of arms 211 pivotally connected between the housing and the frame of the stitcher. The mechanism 204 in addition to accommodating varying set thicknesses, varies the clamping pressure applied to the set as a function of set thickness. Thus, the thinner the set the less the compression of spring 206 and the less the clamping force applied. The clincher ears 204 are positioned in fixed relation to the housing 202 so that they are always presented to the set in the same relation regardless of the set thickness.

The wire advancing and cutting mechanism 103 comprises movable wire advancing and cutter blocks 120, 121 and an inhibitor member 124 positioned by the clincher 201 in dependence on the thickness of the set of sheets SS. The blocks 120, 121 includes wire diodes 122, 123 which grip the wire only against movement relative to the respective block in the direction opposite the wire advancing direction. Thus, the diodes grip the wire when the blocks are moved to the left but allow each block to be moved to the right along the wire while the other block holds the wire. At the start of a wire feed cycle, the blocks 120 and 121 are positioned as shown in dotted lines in FIG. 1. To feed the wire W, the advancing block 120 is moved to the left, its diode 122 gripping the wire, to advance the wire past the rest or start-of-cycle position of the cutter 125 by a distance made up of a constant (crown length plus twice clinch length) plus the set thickness and the cutter block is retracted from its rest position by a distance equal to the set thickness. These movements and thus the length of wire C presented to the stitcher head 101 for severing by the cutter 125 is determined by the inhibitor member 124 which limits the movement of the blocks 120, 121, according to the thickness of the set. The blocks 120, 121 are shown in full lines in their final positions at the end of a wire advancing movement. As the mechanism recycles to its start position (which takes place at the end of the complete stitching cycle) the cutter block 121 returns to its rest position pulling the wire with it—so that the wire end is always in the same position at the start of a feed cycle—and the advancing block 120 traverses back along the wire to its rest position.

While the inhibitor member 124 may be directly connected to the clincher housing 202 as schematically represented in FIG. 2, other arrangements are possible. Thus in a second embodiment as shown in FIG. 7, the inhibitor member 124' is carried on an arm 143 pivoted to the stitcher head at 144 and is positioned by means of an actuator 145 mounted on one of the clincher housing guide arms 211'. As shown the actuator is adjustable for correctly setting the mechanism and comprises a bolt 146 threaded through a bracket 147 and locked into position by a nut 148. While the clincher is retracted, the inhibitor is supported by a limit stop 149.

The embodiment of FIG. 7 also includes a modified drive for the force ring 205' in which as a space-saving measure, the lever 207' carries a cam follower 270 intermediate the force ring 205' and pivot axis 209 which is controlled by a face cam 219 the centre-line of the guideway of which is shown by the dash-dot line 219*a*. The cam 270 is mounted on a cam shaft 218.

The length of wire presented to the stitcher head 101 by the mechanism 103 is cut, formed and driven in the following manner. While the anvil 104', which is pivotally mounted at 107' and biassed to its start-of-cycle position by a spring 108 as shown in FIG. 2, is held against movement, the driver 106 is moved downwardly against the wire to clamp it in position on the anvil. The former elements 105 then start moving downwardly. Initial movement of the former operates the cutter 125 through actuator 109 to sever the required wire length and further movement thereof shapes the wire about the anvil 104' into a generally U-shape. In order to accommodate the wire during this operation, the formers have guide grooves 110 along their inner faces. At the end of the forming operation the former is in its lower limit position with the lower ends of the former elements 105' below the underside of the anvil 104' and adjacent the set. The driver 106 is now driven downwardly, pivoting the anvil about its axis 107', to drive the formed staple. As seen in FIG. 7, the anvil includes a sloping surface 104*a'*. During the driving operation, the anvil surface 104*a'* forms a support for the crown of the staple. Similarly the former elements serve to support the legs of the staple in the grooves 110 during the driving movement.

It will be realised from the foregoing that the anvil must be held against movement during the cutting and forming stage but be pushed out of the way during the driving stage. This may be achieved by using a spring 108 which is strong enough to hold the anvil stationary during cutting and forming. However, this requires that the force available to drive the driver must be sufficient also to overcome the resistance of the spring. It is preferred therefore that as described with reference to our copending U.S. Ser. No. 106,324 filed concurrently herewith, the anvil be held locked in position during the cutting and forming stage and released by the former 105' at the end of its travel whereby only a relatively light spring 108 is required which is sufficient to return the anvil to its start-of-cycle position and to ensure that the anvil supports the staple crown during the driving stage. One way of achieving this is shown in FIG. 7 in which the anvil is geometrically locked in position during the cutting and forming steps by arranging the pivot axis 107' above the line of pressure engagement between driver and anvil, the lock being released by a projection 190 on the former engaging an actuator surface 170 on the anvil support area.

As described above, the stitcher has a two stage driver action in which following wire feed a first stage motion operates to grip the wire W against the anvil 104' during cutting and forming and a second stage motion acts following forming to effect driving of the formed staple. A mechanism suitable for this operation based on pivoted motions which first holds the wire against the anvil and then provides the driving motion all from one continuous input lever travel is described in our copending U.S. Ser. No. 106,421 filed concurrently herewith.

The ends of the staple legs are turned over and wiped flat against the underside of the set by the clincher ears 204. The clincher 201 is operated as described more fully below so that the staple legs having passed through the set move through air and meet no further resistance during driver travel. This is achieved by arranging the clincher ears out of the paths of the staple legs during driver travel so that leg wander is accommodated wholly within the clinch ears by profiling the ears with the groove wide enough to accommodate the maximum leg wander anticipated. The drive to the clincher ears may in accordance with our copending U.S. Ser. No. 106,103 filed concurrently herewith be by a spring which is loaded during return motion of the clincher housing at the completion of a stitching operation as more fully described with reference to FIGS. 5 and 6, the clinch ears being held latched in the position shown in FIG. 2 prior to the operation thereof, or by a cam drive 259 as described with reference to FIG. 7.

One embodiment of clincher is shown in FIGS. 5 and 6 in which the clincher ears are driven by a spring 220 which is loaded during return motion of the clincher housing at the end of a stitching operation, the ears 204 being held latched in the position shown by a latch 221. The ears themselves are pivotally mounted at 204*a* on a bracket 212 carried by the clincher rod 213 and the spring 220 is a compression spring surrounding the rod 213 and extending between the bracket 212 and the base 214 of the clincher housing 202. The ears have V-grooves 215*a*, 216*a* in their facing edges 215 and upper edges 216 respectively and these are suitably profiled as described more fully with respect to FIG. 11. In particular, the grooves 215*a* are arranged to catch the ends of the driven staple legs and dimensioned to be sufficiently wide to accommodate normal leg wander, the grooves 216*a*, which merge with the associated grooves 215*a*, being narrower and arranged to align the staple legs. When the latch 221 is released the spring drives the bracket 212 upwardly and the ears simultaneously pivot about the bracket 212 and turn around pivot bar 217 which is fixed to the clincher housing into a final position (not shown) in which their facing edges 215 meet and their upper edges 216 are generally horizontal and flush with, preferably projecting slightly above, the clamping surface 203. During this movement the staple (stitch) legs are gathered by the V-grooves 215*a* and aligned by the V-grooves 216*a*, being bent over and wiped flat against the underside of the set initially by the grooves 215*a* and then by the grooves 216*a*. For loading the spring 220, the lower end of the rod 213 is pivotally connected to a lever arm 222 which is itself pivoted at 223 to a bracket 224 secured to one side of the clincher housing 202. A fixed stop 225 limits downward movement of the free end 222*a* of the lever arm 222. As the clincher housing is lowered at the end of a stitching operation, the end 222*a* of arm 222 is arrested by the stop 225 so that the clincher rod 213 is drawn downwardly relative to the housing returning the ears 204 to the positions shown and loading the spring 220. The latch 221 is operated off the driver 106 via trip mechanism 230. This comprises a master crank lever 231 pivoted to the stitcher head frame about a fixed axis 232 and a slave lever 233 mounted for rotation with a shaft 234 carried in bearings in the clincher housing base 214 and incorporating latch 221 as a D-section portion thereof. The slave lever 233 is biassed into engagement with the master lever 231 by a spring 235 and the faces 231*a*, 233*a* of the levers slide over each other as the clincher housing is raised and lowered during stitching.

In operation, as the clincher housing 202 is raised to clamp a set against the stitcher head, the clincher ears 204 remain latched, the lever 233 sliding along lever 231. The master lever 231 is pivoted to rotate the slave lever 233 and unlatch the clincher rod by an actuator 240 on the driver 106 so that the operation of the clincher ears is timed off the driver. Since the master lever 231 has its pivot axis fixed relative to the head, the timing is unaffected by set thickness. Specifically, the actuator 240 is arranged to unlatch the clincher rod 213 only after the staple has been completely driven through the set with its crown against the upper face of the set.

A second embodiment of clincher is illustrated in FIGS. 7 to 10. Here, the clincher rod is replaced by a slider 263 which slides in grooves in the wall of the clincher housing 202' and the bracket is formed by a pair of mounting plates 212*a*. The slider is driven by an edge or ramp cam 250 mounted on the same drive shaft 218 as, and alongside, the cam 219 which drives the force-ring lever 207'. The drive to the slider 263 from the cam 250 is effected by a roller follower 251 mounted on one end of a crank arm 252 pivoted to a bracket 253 depending outwardly from the clincher housing 202'. The other end of the crank arm carries a stop 254 which engages the bottom end of the clincher slider 263. As shown, the stop 254 is adjustable to permit setting of the clincher ear movement. The clincher ears 204' are biassed to their open, retracted position by a spring 255 mounted in an aperture 256 in the slider assembly and acting on a shoulder 257 of the housing 202'. The cam shaft 218 is driven in synchronism with the head 101 drive and the cam 250 is disposed so that the clincher slider is driven only after the formed staple has been completely driven through the set. It will be noted that by using a drive arrangement as shown with the face cam 250, variations in set thickness are accommodated without affecting the timing (except to an insignificant degree caused by slight variations in the position of the cam follower 250 to cam 251) of the clincher ear movement relative to that of the driver.

As in the embodiment described above, the ears 204' have catcher grooves 215*a* dimensioned to accommodate normal leg wander in their facing side edges 215 and narrower, aligning grooves 216*a* in their top or end edges 216. The grooves 215*a* catch the ends of the driven staple legs and initiate bending thereof, the grooves 216*a* aligning the legs and completing the bending thereof. As the slider 263 is driven upwardly by cam 250, the clincher ears move between a retracted position seen in FIG. 9 and a clinch completed position seen in FIG. 10, during which movement the ears are simultaneously raised and pivot on their axes 204*a'*, turning about the fixed pivot bar 217. This turning movement about the bar is possible due to a slight clearance between the bearing surfaces 227 of the ears and the bar. In their retracted positions, the side edges 215 of the ears are inclined towards each other in the direction towards the pivot bar 217, i.e. in the staple driving direction, and their end edges are inclined away from each other in the same direction. The ears are positively held in their retracted positions (thus ensuring proper clearance for the staple legs during driving) by the spring 255 which urges the ears downwardly until their back edges 226 are pressed against the side wall of the clincher housing by the reaction of the ear bearing surfaces 227 with the bar 217. In the clinch completed positions of the ears, their side edges 215 are in contact and generally parallel and their end edges 216 are coextensive and parallel to and projecting slightly above the clamping surface 203.

Referring particularly now to FIG. 11, it will be seen that the grooves 215*a* and 216*a* are connected by a transition groove portion 228 at the junction between the side and end edges 215, 216. This transition groove portion 228 in the form of ear illustrated initiates the alignment of the staple leg which is here completed by the groove 216*a*. In order to ensure that the ends of the ears come fully together in their clinch completed positions, the edges 215 are, as shown, relieved below the effective portion of the groove 215*a* although the latter does include a (perforce narrower) run-out portion 215*b* in the relieved edge part.

The dimensions of the grooves will depend on various factors relating to the staples and the sets with which the clincher is designed for use. The groove 215*a* should be wide enough to accommodate normal leg wander while the groove 216*a* should be narrower so as to align the leg yet not so narrow as not to allow for the varying set exit position of the leg. The groove 215*a* should be deep enough that the leg is held against sideways movement yet shallow enough that the inner end of the groove 216*a* is not set so far back that it will not act properly on longer clinches. The groove 216*a* itself should be sufficiently shallow that the leg is pressed firmly against the set yet sufficiently deep that it acts to align the staple leg. With these sometimes conflicting requirements in mind a clincher for use in binding sets up to about 10 mm thick suitably has a V-shaped groove 215*a* which is 3–4 mm wide with an included angle of 90°–150° and a V-shaped groove 216*a* which is 1.0–1.5 mm wide with an included angle of 80°–110°. The lengths of the grooves will depend inter alia on the maximum clinch length but in one embodiment in which the ears are retracted 2.5 mm below the clamping surface 203', the grooves 215*a* are 6 mm long (allowing a maximum clinch length of 8 mm) and the grooves 216*a* are 8.5 mm long.

One embodiment of clincher for use in a stitcher in which staples are cut and formed from steel wire stock 0.6–0.7 mm in diameter and capable of accommodating sets up to 10 mm thick, has ears with V-grooves 215*a* which are 3.5 mm wide and V-grooves 216*a* which are 1.2 mm wide, the former having an included angle of 120° and the latter an included angle of 90°. In the retracted positions of the ears, their edges 215 together define an included angle of about 48°.

In a modification as shown in FIG. 12, the end edges 216 of the ears 204' are, in their clinch completed positions, inclined at an angle A of not more than about 8° and preferably 5° or less, e.g. 2° or 3°, to the set clamping surface 203', so as slightly to overclinch the staple.

Whilst specific embodiments of the invention have been described above it will be understood that various modifications may be made to the specific details referred to herein without departing from the scope of the invention as defined in the appended claims. Thus, the principles of this invention although described in relation to a flat bed stitcher may equally be applied to a saddle stitcher.

Further, while in the apparatus described above the stitcher is fixed in position, it may be movable for varying the position of the stitch or for inserting more than one stitch in a set. Also, two or more stitchers according to the invention, which may themselves be movable, may be operated in tandem, in which case various of the drive elements may be common to avoid duplication.

It will also be understood that while in the embodiments described, the stitcher head is fixed, the clincher could be fixed and the clamping means be formed by the sheet receiving surface of the head itself.

It will further be understood that although the embodiments of stitcher described and illustrated show the stitcher head above the clincher, the stitcher may be arranged in any suitable orientation and specifically the clincher may be arranged over the stitcher head.

For clarity, it is to be noted that the term staple is used herein to mean either a wire-fastener which is pre-formed outside the stitching machine or one which is formed within the machine.

Although in the embodiments described herein the stitcher head 101 and the associated clamping surface are fixed and the clincher 201 and its associated clamping surface are movable, other arangements are possible. Thus, the clincher may be stationary or both the stitcher head and the clincher may move.

Whereas in the embodiments illustrated, the edges 216 of the ears are at least as long as the clinch, it is to be understood that the edge 216 and thus the groove 216*a* need only be long enough to act on the end of the clinch.

What is claimed is:

1. A wire stitcher for binding a set of sheets having a driver for driving a staple through a set, and an active clincher for bending over the ends of the staple legs to form clinches, the improvement wherein the clincher includes a clincher ear having a first groove for catching the end of the staple and initiating bending of the leg and a second narrower groove contiguous with said first groove for aligning the leg and completing the bending thereof, said first and second grooves are respectively formed in a side edge and an end edge of said ear with a transition groove portion between said grooves at the junction of said edges.

2. The invention according to claim 1 wherein the clincher includes a set clamping surface and two clincher ears, said ears being movable between a retracted position behind said surface in which their side and end edges are respectively inclined towards and away from each other in the direction away from the set clamping surface and a clinch completed position in which the side edges are generally parallel and the end edges project slightly beyond said clamping surface.

3. The invention according to claim 2 wherein said end edges are inclined away from each other by an angle of not more than eight degrees when in the clinch completed position.

4. The invention according to claim 3 wherein said angle is five degrees.

* * * * *